US009475277B2

(12) United States Patent
Ohnishi

(10) Patent No.: US 9,475,277 B2
(45) Date of Patent: Oct. 25, 2016

(54) PRINTING DEVICE

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/430,914

(22) PCT Filed: Sep. 24, 2013

(86) PCT No.: PCT/JP2013/075610
§ 371 (c)(1),
(2) Date: Mar. 25, 2015

(87) PCT Pub. No.: WO2014/050777
PCT Pub. Date: Apr. 3, 2014

(65) Prior Publication Data

US 2015/0251409 A1 Sep. 10, 2015

(30) Foreign Application Priority Data

Sep. 28, 2012 (JP) ..... 2012-218345

(51) Int. Cl.
*B41J 2/01* (2006.01)
*B41J 2/005* (2006.01)
*B41J 11/00* (2006.01)

(52) U.S. Cl.
CPC ..... *B41J 2/0057* (2013.01); *B41J 2/01* (2013.01); *B41J 11/002* (2013.01); *B41J 2002/012* (2013.01)

(58) Field of Classification Search
CPC B41J 11/0015; B41J 11/002; B41M 7/0072; B41M 7/0081; B41M 7/009
USPC ..... 347/101–102
See application file for complete search history.

(56) References Cited

U.S. PATENT DOCUMENTS 8,025,388 B2 * 9/2011 Kadomatsu et al. ..... 347/103
8,025,389 B2 * 9/2011 Yamanobe et al. ..... 347/103

(Continued)

FOREIGN PATENT DOCUMENTS

JP 2006-102977 4/2006
JP 2006-130725 5/2006

(Continued)

OTHER PUBLICATIONS

"International Search Report (Form PCT/ISA/210)", mailed on Oct. 22, 2013, with English translation thereof, pp. 1-4.

(Continued)

*Primary Examiner* — Alessandro Amari
*Assistant Examiner* — Jeremy Bishop
(74) *Attorney, Agent, or Firm* — Jianq Chyun IP Office

(57) ABSTRACT

It is aimed to provide a printing device capable of sequentially perform printing on recording medium and the like. As a solution thereto, a printing device 100 according to the present invention includes an ink jet head 1, a ring-shaped transfer belt 2 that transfers ink onto a medium 12, an ultraviolet irradiator 4 that cures the ink at a degree that is not completely cured, a driving roller 8 that rotationally drives the transfer belt 2, a transparent roller 9 and a transfer roller 10 that transfer the ink onto the medium 12, and an ultraviolet irradiator 5 that cures the ink.

5 Claims, 2 Drawing Sheets

(56) References Cited

U.S. PATENT DOCUMENTS

| | | | | |
|---|---|---|---|---|
| 8,113,646 | B2 * | 2/2012 | Elrod et al. | 347/104 |
| 8,177,332 | B2 * | 5/2012 | Thompson et al. | 347/51 |
| 8,342,672 | B2 * | 1/2013 | Yamashita et al. | 347/102 |
| 8,696,102 | B2 * | 4/2014 | Shimizu | 347/102 |

FOREIGN PATENT DOCUMENTS

| | | |
|---|---|---|
| JP | 2009-078391 | 4/2009 |
| JP | 2011-056743 | 3/2011 |
| JP | 2012-091458 | 5/2012 |
| JP | 2012-111123 | 6/2012 |
| JP | 2012-148420 | 8/2012 |

OTHER PUBLICATIONS

Office Action of Japan Counterpart Application with English translation, issued on Jul. 5, 2016, p. 1-p. 7.

* cited by examiner

PRINTING DEVICE

CROSS-REFERENCE TO RELATED APPLICATION

This application is a 371 application of the international PCT application serial no. PCT/JP2013/075610, filed on Sep. 24, 2013, which claims the priority benefit of Japan application no. 2012-218345, filed on Sep. 28, 2012. The entirety of each of the above-mentioned patent applications is hereby incorporated by reference herein and made a part of this specification.

TECHNICAL FIELD

The present invention relates to a printing device.

BACKGROUND ART

There is Patent Document 1 as a document that describes an offset printing method by an ink jet scheme. Patent Document 1 describes a method that includes a first step of printing a UV ink image on a planar negative by an ink jet using UV ink, a second step of making the UV ink image in a semi-dried state by performing UV or electron beam irradiation while printing the UV ink image or just after the printing, a third step of transferring the UV ink image in the semi-dried state onto an elastic blanket surface, a fourth step of offset printing the UV ink image transferred onto the elastic blanket onto a print object, and a step of drying and fixing the UV ink image that has been offset printed.

PRIOR ART DOCUMENT

Patent Document

Patent Document 1: JP 2006-130725 A (published on May 25, 2006)

SUMMARY OF THE INVENTION

Problem to be Solved by the Invention

However, such a conventional technique as above is used for printing on a recording medium (print object) on one-by-one basis, and printing sequentially on a web-shaped recording medium, or printing with long printing length were not possible.

The present invention has been made in view of the above problem, and aims to provide a printing device that can print sequentially on a web-shaped recording medium, or printing with long printing length.

Solutions to the Problem

To solve the above problem, a printing device according to the present invention is characteristic in including: an ink jet head that discharges ink that is cured by having radiation delivered; a ring-shaped transfer medium being a transfer medium onto which the ink is discharged, being configured to transfer the ink onto a recording medium by causing the ink discharged on the transfer medium to make contact with the recording medium; a first curing unit that cures the ink discharged on the transfer medium at a degree that is not completely cured; a driving unit that rotationally drives the transfer medium; a transferring unit that presses the transfer medium, on which the ink cured by the first curing unit has been discharged, and the recording medium to transfer the ink onto the recording medium; and a second curing unit that irradiates the ink on the recording medium to cure the ink.

Firstly, the ink jet head prints the ink that is cured by having radiation delivered thereon on the ring-shaped transfer medium. The first curing unit cures the ink at the degree that is not completely cured. Then, the transferring unit transfers the ink cured by the first curing unit onto the recording medium, whereby the ink does not soak into the recording medium, or smear thereon. Thus, the printing device according to the present invention can provide print image with high quality.

The printing device according to the present invention uses the ring-shaped transfer medium, so that printing can be performed sequentially on a web-shaped recording medium, or printing with long printing length can be performed.

In the printing device according to the present invention, more preferably, the transferring unit includes a first roller provided inside a ring of the ring-shaped transfer medium, and a second roller provided at a position facing the first roller with the transfer medium and the recording medium sandwiched therebetween, and the first roller and the second roller press the transfer medium and the recording medium.

According to the above configuration, the first roller and the second roller sandwich the transfer medium and the recording medium, and further press them. Due to this, the ink on the transfer medium can sequentially be transferred onto the recording medium.

In the printing device according to the present invention, more preferably, the second curing unit is installed in the first roller, and the first roller is a roller that allows radiation to penetrate, or is a roller having a gap for allowing radiation to pass through, and the transfer medium is formed of a member that allows radiation to penetrate.

The first roller is a roller that allows radiation to penetrate or to pass through, and the transfer medium is formed of the member that allows radiation to penetrate. Due to this, the pressing of the transfer medium and the recording medium and the delivery of the radiation onto the ink on the recording medium can both be performed at once. Thus, the ink on the transfer medium can efficiently be transferred onto the recording medium.

Further, since the ink on the recording medium is cured in a state where the transfer medium and the recording medium are pressed, image surface upon the transfer is smoothed, and image quality is improved.

Moreover, since the second curing unit is installed in the first roller, the printing device can be made compact.

In the printing device according to the present invention, more preferably, the ink jet head moves in a direction that is a vertical direction with respect to a moving direction of the transfer medium and is a direction parallel to a surface direction of the transfer medium, and the first curing unit delivers the radiation onto the ink on the transfer medium and cures the ink at the degree that is not completely cured, and moves in a state in which a relative position with respect to the ink jet head is maintained.

The first curing unit delivers the radiation on the ink on the transfer medium while moving in the state of maintaining the relative position with respect to the ink jet head. That is, since the ink is cured while discharging the ink from the ink jet head onto the transfer medium, for example, the ink that has just struck the transfer medium can be cured. Thus, the ink smearing on the transfer medium can be prevented.

In the printing device according to the present invention, more preferably, the first curing unit includes a heating unit that heats a surface of the transfer medium onto which the ink is discharged.

The ink discharged onto the transfer medium can be heated by the heating unit. Due to this, for example, in the case where solvent is included in the ink, the solvent can be volatilized to increase viscosity of the ink to suppress ink smearing and excessive leveling.

In the printing device according to the present invention, more preferably, the heating unit heats the surface of the transfer medium onto which the ink is discharged to 40° C. or more and 80° C. or less.

By heating the ink on the transfer medium within the above temperature range, the solvent included in the ink can efficiently be volatilized to suitably increase viscosity of the ink.

Effects of the Invention

The printing device according to the present invention achieves the advantageous effect of being able to print sequentially on a web-shaped recording medium, or being able to print with long printing length.

BRIEF DESCRIPTION OF THE DRAWINGS

FIG. 3A is a front view of the printing device, and FIG. 3B is a top view thereof.

EMBODIMENTS OF THE INVENTION

First Embodiment

Figure 1:
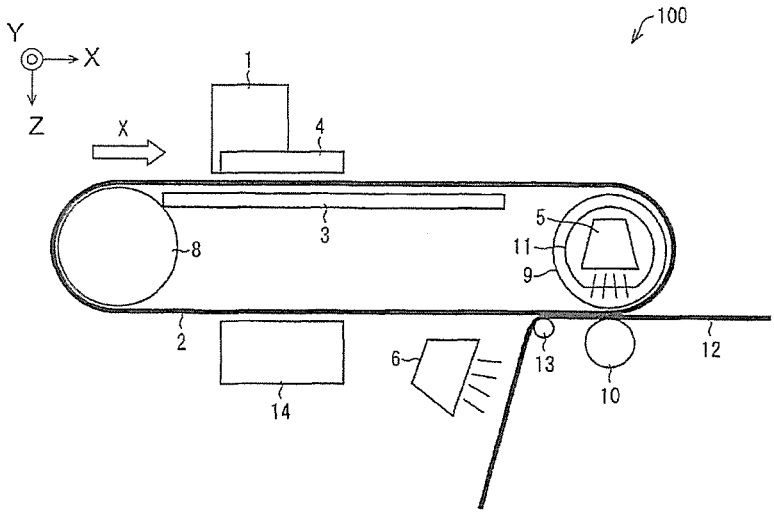
FIG. 1 is a diagram schematically showing a printing device according to a first embodiment of the present invention.

Hereinbelow, a first embodiment of the present invention will be described in detail using FIG. 1. FIG. 1 is a diagram schematically showing a printing device according to the first embodiment of the present invention.

[Printing Device 100]

A printing device 100 according to one embodiment of the present invention includes an ink jet head 1, a transfer belt (transfer medium) 2, a heater (heating unit) 3, an ultraviolet irradiator (first curing unit) 4, an ultraviolet irradiator (second curing unit) 5, an ultraviolet irradiator 6, a driving roller (driving unit) 8, a transparent roller (transferring unit, first roller) 9, a transfer roller (transferring unit, second roller) 10, a reflection cylinder 11, a small roller 13, and a cleaner 14.

The printing device 100 transfers ink discharged from the ink jet head 1 onto the transfer belt 2 onto a medium (recording medium) 12.

(Ink Jet Head 1)

The ink jet head 1 discharges ink that is cured by delivery of ultraviolet ray (radiation). Further, the ink jet head 1 discharges the ink onto the transfer belt 2 while moving in a direction that is vertical to a moving direction of the transfer belt 2 (direction of arrow X in FIG. 1) and parallel to a surface direction of the transfer belt 2, and draws an image on the transfer belt 2.

(Medium 12)

The medium 12 is a recording medium onto which the ink discharged from the ink jet head 1 is painted. The recording medium can be determined according to purposes, for example, a plate-shaped member, a sheet-shaped member, a web-shaped member may be exemplified, and more specifically, paper, plastic sheet, labels and the like may be exemplified.

<Ink>

The ink used in the printing device according to the present invention is ink that is cured by delivery of the radiation. For example, the ink includes at least one type of curable monomers and curable oligomers that are polymerized by delivery of the radiation.

That is, at least one type of the curable monomers and curable oligomers is polymerized by delivering the radiation on the ink. In this description, "radiation" is a collective term for various corpuscular beams and electromagnetic waves, where an electron beam is exemplified for example as the corpuscular beam, and ultraviolet ray is exemplified for example as the electromagnetic wave.

It should be noted that, in this description, a "curable monomer" means a monomer that is polymerized by external stimulus being applied thereto and forms cured resin, and a "curable oligomer" means an oligomer that is polymerized by external stimulus being applied thereto and form is cured resin. For example, an ultraviolet curable monomer or ultraviolet curable oligomer that is cured by the delivery of the ultraviolet ray (hereafter, "ultraviolet" may be termed "UV"), or an electron beam curable monomer or electron beam curable oligomer that is cured by the delivery of the electron beam may be exemplified. The curable monomer or curable oligomer is polymerized and cured to increase viscosity thereof. It should be noted that, in the printing device 100 according to the below embodiments, ultraviolet ray is used as the radiation, and the ultraviolet irradiator 4 and ultraviolet irradiator 5 that respectively delivers the ultraviolet ray are used as a first curing unit and second curing unit to be described later, however, no limitation is made hereto.

The ink used in the printing device according to the present invention may include solvent. If the ink includes the solvent, the viscosity is increased by heating the ink and evaporating the solvent. Further, by the ink being diluted by the solvent, curing does not take place as much as in conventional UV ink even when UV is delivered while heating the ink, and an adjustment of the curing degree of the ink by the radiation such as ultraviolet ray is easy.

As the solvent, for example, glycol ethers and glycol ether acetates such as propylene glycol monomethyl ether, ethyleneglycol monomethyl ether acetate, ethyleneglycol monoethyl ether acetate, ethyleneglycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, ethyleneglycol monomethyl ether propionate, ethyleneglycol monoethyl ether propionate, ethyleneglycol monobutyl ether propionate, diethylene glycol monomethyl ether propionate, diethylene glycol monoethyl ether propionate, diethylene glycol monobutyl ether propionate, propylene glycol monomethyl ether propionate, dipropylene glycol monomethyl ether propionate, ethyleneglycol monomethyl ether butyrate, ethyleneglycol monoethyl ether butyrate, ethyleneglycol monobutyl ether butyrate, diethylene glycol monomethyl ether butyrate, diethylene glycol monoethyl ether butyrate, diethylene glycol monobutyl ether butyrate, propylene glycol monomethyl ether butyrate, dipropylene glycol monomethyl ether butyrate, and the like may be exemplified.

Further, other than the above, the solvent may be a hydrocarbon-based solvent. As the hydrocarbon-based solvent, for example, n-hexane, n-heptane, n-octane, isooctane, cyclohexane, methyl cyclohexane, benzene, toluene, o-xylene, m-xylene, p-xylene, ethyl benzene and the like may be exemplified.

Further, other than the above, the solvent may be an ester-based solvent. As the ester-based solvent, for example, formic propyl, formic-n-butyl, formic isobutyl, formic amyl, ethyl acetate, n-propyl acetate, isopropyl acetate, n-butyl acetate, isobutyl acetate, sec-butyl acetate, n-amyl acetate, isoamyl acetate, methyl isoamyl acetate, sec-hexyl acetate, methyl propionate, ethyl propionate, n-butyl propionate, methyl butyrate, ethyl butyrate, methyl lactate, γ-butyrolactone and the like may be exemplified.

Further, other than the above, the solvent may be a ketone-based solvent. As the ketone-based solvent, for example, methyl ethyl ketone, methyl n-propyl ketone, methyl n-butyl ketone, methyl isobutyl ketone, diethyl ketone, ethyl n-butyl ketone, di-n-propyl ketone, mesityl oxide and the like may be exemplified.

The solvent that may be included in the ink used for the printing device according to the present invention is preferably at least one component selected from among the group of solvent as described above. By using the above solvent, evaporation of the solvent upon heating can efficiently be performed.

As ink viscosity, those suitable for the aim can be used, however, it is preferable to have the value of 3 mPa·sec or more and 20 mPa·sec or less at 25° C. before the delivery of ultraviolet ray onto the ink by the ultraviolet irradiator 4. Due to this, the discharge from the ink jet head 1 can be facilitated easily, and further the ink can be prevented from smearing on the medium 12.

By the ultraviolet irradiator 4 delivering the ultraviolet ray onto the ink, the viscosity of the ink can be increased, and the ink can be cured to a degree that is not completely cured. At this occasion, the viscosity of the ink is preferably increased to 1,000 mPa·sec or more and 50,000 mPa·sec or less, and more preferably increased to 4,000 mPa·sec or more and 5,000 mPa·sec or less. By increasing the ink viscosity within the above range, the ink is not smeared upon transferring the ink on the transfer belt 2 onto the medium 2, and the ink can suitably be transferred onto the medium 12, as a result of which a medium 12 on which high quality image is transferred can be obtained. In this description, "curing the ink at a degree that is not completely cured" means that by delivering radiation onto the ink on the transfer medium, the viscosity of the ink is increased and the ink is cured to a degree by which the image is not deteriorated upon transferring the image from the transfer medium onto the recording medium.

The content of the solvent relative to entire amount of the ink can suitably be set in accordance with the purpose, however, it is preferable to be 10 wt % or more, and it is more preferable to be 55 wt % or less. In this range, the ink viscosity can easily increase by heating.

As the ink color, for example, various colors can be exemplified, such as normal colors of Y (Yellow), M (Magenta), C (Cyan), and K (Black), specific colors such as light colors of these normal colors, white, metallic, clear, and the like, or a combination thereof, and no limitation is made hereof.

(Transfer Belt 2)

The transfer belt 2 is a ring-shaped member that transfers the ink onto the medium 12 by causing the ink discharged from the ink jet head 1 to make contact with the medium 12. Further, in the present embodiment, the transfer belt 2 is formed of a member that allows ultraviolet ray to penetrate.

As the transfer medium such as the transfer belt 2, various types may be used in accordance with purposes, however, it is more preferable to be deformable along a print target surface of the recording medium. As the material of the transfer medium, for example, there is no limitation so long as it is a material having heat durability and ability to allow radiation to penetrate, and being able to be subjected to ink jet printing, and a silicone rubber, a silicone resin-coated flexible film, or a film that does not have strong adhesiveness to ink may be exemplified. Further, other than the silicone rubber, rubber such as urethane rubber and Teflon (registered trademark) rubber, elastomeric resin by itself, or a composite material having a transfer surface formed of the aforementioned material and the like may be exemplified, and selection can suitably be made from among them in accordance with purposes. With such a transfer medium, transfer can be performed by directly pressing the surface of the transfer medium where the ink is present against the recording medium to make tight contact, so that ink transfer can easily be performed. Further, the thickness of the transfer belt 2 is preferably 0.1 mm or more and 5.0 mm or less.

Further, in case of configuring the transfer medium to be disposable, it may be an object of which shape does not return, instead of an object that returns to its original shape when pressure is released as in rubber. As the object of which shape does not return, for example, thermoplastic thin resin film such as a laminate film may be exemplified.

The hardness and the thickness of the transfer medium may suitably be changed according to the shape of the recording medium. It is preferable to employ ones with lower hardness and thinner thickness for more complex shaped recording medium. If the recording medium is a flat plate, the transfer medium may be rubber plate-shaped.

(Heater 3)

The heater 3 is for heating a surface of the transfer belt 2 onto which ink is discharged. Further, the heater 3 is provided to face the transfer belt 2.

The ink discharged on the transfer belt 2 can be heated by the heater 3. Due to this, if solvent is contained in the ink, the solvent can be volatilized to increase the viscosity of the ink, whereby smearing and excess leveling of the ink can be suppressed.

The heater 3 preferably heats the surface of the transfer belt 2 onto which the ink is discharged to 40° C. or more and 80° C. or less, more preferably heats the same to 45° C. or more and 70° C. or less. By heating the ink on the transfer belt 2 within the above temperature range, the solvent contained in the ink can efficiently be volatilized to suitably increase the viscosity of the ink.

As the heater 3, there is no limitation so long as it can heat the surface of the transfer belt 2 onto which the ink is discharged, however, for example, a ceramic heater, a tungsten heater, a sheathed wire heater, a far infrared ray heater, an IH heater, a warm air heater, or combinations thereof may be exemplified.

(Ultraviolet Irradiator 4)

The ultraviolet irradiator 4 delivers ultraviolet ray onto the ink on the transfer belt 2 to cure the ink at a degree that is not completely cured.

Further, the ultraviolet irradiator 4 delivers ultraviolet ray onto the ink on the transfer belt 2 while moving in a state of maintaining a relative position with respect to the ink jet head 1. That is, since ink is cured while discharging the ink from the ink jet head 1 onto the transfer belt 2, for example, the ink that has just struck the transfer belt 2 can be cured. Accordingly, the smearing of the ink on the transfer belt 2 can be prevented.

In the ultraviolet irradiator 4, to maintain the relative position with respect to the ink jet head 1, for example, the ultraviolet irradiator 4 may directly or indirectly be provided on the ink jet head 1, and move the ultraviolet irradiator 4 and the ink jet head 1 in cooperation.

(Driving Roller 8)

The driving roller 8 is provided inside the transfer belt 2, and is a driving unit that rotationally drives the transfer belt 2. As shown in FIG. 1, for example, the transfer belt 2 moves in a direction of an arrow X by rotation of the driving roller 8.

As to the configuration of the driving unit, there is no limitation so long as it is configured to rotationally drive the transfer medium; for example, it may be a configuration of a belt conveyor and the like.

(Transparent Roller 9)

The transparent roller 9 is a part of the transferring unit that presses the transfer belt 2, on which the ink cured by the ultraviolet irradiator 4 is adhering, and the medium 12, to transfer the ink onto the medium 12. In the present embodiment, the transferring unit provided in the printing device according to the present invention is configured of the transparent roller 9 and the transfer roller 10 to be described later. Further, the transparent roller 9 is provided inside the ring of the ring-shaped transfer belt 2, and is a roller (first roller) that allows ultraviolet ray to penetrate.

As the first roller, for example, a roller formed of quartz glass, glass material such as Pyrex (registered trademark) glass, or a resin material such as acryl, polyethylene, polyamide-imide resin, and epoxy resin may be exemplified.

(Transfer Roller 10)

The transfer roller 10 is a part of the transferring unit that presses the transfer belt 2, onto which the ink cured by the ultraviolet irradiator 4 is discharged, and the medium 12, to transfer the ink onto the medium 12. Further, the transfer roller 10 is a roller (second roller) provided at a position facing the transparent roller 9 with the transfer belt 2 sandwiched therebetween. Due to this, as shown in FIG. 1, when the transfer belt 2 and the medium 12 are sandwiched between the transparent roller 9 and the transfer roller 10, the transparent roller 9 and the transfer roller 10 press the transfer belt 2 and the medium 12.

As the second roller, for example, a material thereof is preferably identical to that of the first roller or a rubber material with high hardness. Since the second roller does not need to allow radiation to penetrate, rubber material such as neoprene rubber and chloroprene rubber may be used. By using these rubber materials, the transferring property of the ink can be improved.

(Ultraviolet Irradiator 5)

The ultraviolet irradiator 5 delivers ultraviolet ray onto the ink on the medium 12 to cure the ink. Further, in the present embodiment, the ultraviolet irradiator 5 is installed in the transparent roller 9. Thus, the printing device 100 can be made compact.

The transparent roller 9 is a roller that allows ultraviolet ray to penetrate, so that the ultraviolet irradiator 5 delivers the ultraviolet ray onto the transfer belt 2 through the transparent roller 9. At this occasion, since the transfer belt 2 is formed of the material that allows ultraviolet ray to penetrate, the ultraviolet ray delivered through the transparent roller 9 penetrates the transfer belt 2 and is delivered onto the ink on the medium 12.

(Reflection Cylinder 11)

As shown in FIG. 1, the reflection cylinder 11 may be installed in the transparent roller 9, and the ultraviolet irradiator 5 may be installed in the reflection cylinder 11. By providing the reflection cylinder 11, use efficiency of radiation such as the ultraviolet ray can be improved, and the transparent roller 9 can be strengthened.

(Small Roller 13)

As shown in FIG. 1, the small roller 13 is provided adjacent to the transfer roller 10 in a moving direction of the transfer belt 2. The transfer belt 2 and the medium 12 are making contact between the transfer roller 10 and the small roller 13, but when the transfer belt 2 and the medium 12 are moved to the small roller 13, the medium 12 is detached from the transfer belt 2.

(Ultraviolet Irradiator 6)

The ultraviolet irradiator 6 may be provided to completely cure the ink transferred onto the medium 12. For example, in case where the curing of the ink has been insufficient by the delivery of the ultraviolet ray by the ultraviolet irradiator 5 due to having increased the moving speed of the transfer belt 2, the ultraviolet irradiator 6 can completely cure the ink.

As a specific configuration of the ultraviolet irradiators 4, 5, 6, for example, a UV-LED lamp, a metal halide lamp, a black light, a sterilization lamp, an Xenon lamp and the like, or combinations thereof may be exemplified. As wavelengths of the UV delivered from the ultraviolet irradiator 4, 5, 6, for example, wavelengths of 350 nm or more and 420 nm or less may be exemplified. Further, as to the wavelength of the UV delivered from the ultraviolet irradiator 4, it is preferable to be a wavelength of 380 nm or more and 420 nm or less, as to the wavelength of the UV delivered from the ultraviolet irradiator 5, it is more preferable to be a wavelength of 350 nm or more and 420 nm or less, and as to the wavelength of the UV delivered from the ultraviolet irradiator 6, it is preferable to be a wavelength of 350 nm or more and 410 nm or less. By delivering the ultraviolet ray with the wavelength in the above ranges onto the ink, the ink can suitably be cured.

The wavelength of the UV delivered onto the ink from the ultraviolet irradiator 4 is preferably longer than the wavelength of the UV delivered onto the ink from the ultraviolet irradiator 5. The UV with the longer wavelength from the ultraviolet irradiator 4 is delivered onto the struck ink to cure the ink to its inside, and the UV with the shorter wavelength is delivered from the ultraviolet irradiator 5 to cure the surface of the ink, whereby the ink can easily be exfoliated from the transfer belt 2 when transferring the ink onto the medium 12.

(Cleaner 14)

To remove the ink remaining on the transfer belt 2, the cleaner 14 may be provided. Due to this, the transfer belt 2 can be reused. The cleaner 14 simply needs to be at a position where the ink adhered onto the transfer belt 2 can be removed after the ink transfer onto the medium 12 has been finished and before the ink is discharged by the ink jet head 1. For example, as shown in FIG. 1, the cleaner 14 can simply be provided between the small roller 13 and the ink jet head 1 in the moving direction of the transfer belt 2 (direction of the arrow X).

[Ink Transfer by Printing Device 100]

Next, a method of transferring the ink on the transfer belt 2 onto the medium 12 by using the printing device 100 according to the present embodiment will be described.

Firstly, the ink is discharged onto the transfer belt 2 while scanning the ink jet head 1. At this occasion, the ultraviolet irradiator 4 delivers the ultraviolet ray onto the ink on the transfer belt 2 in the state of maintaining the relative position with respect to the ink jet head 1, whereby the viscosity of the ink is increased, and the ink is cured to the degree that is not completely cured. Due to this, the print image that is cured to a degree by which the image is not deteriorated is formed on the transfer belt 2.

Further, the ink on the transfer belt 2 may be heated by the heater 3 while the ultraviolet ray is delivered on the ink on the transfer belt 2 by the ultraviolet irradiator 4. If solvent is contained in the ink, the viscosity of the ink can be increased by evaporating the solvent by the heating, and the ink can be cured. By using both the ultraviolet ray irradiation and the heating, the viscosity of the ink applied to the transfer belt 2 can freely be controlled. Due to this, the viscosity of the ink can be adjusted to a suitable value that is appropriate for the property of the ink to be transferred, the type of the image to be formed by the ink, a three-dimensional shape of the medium 12, and the like, and the viscosity of the ink after the application onto the transfer belt 2 can be adjusted to the desired value.

Further, a simple heating of the ink applied to the transfer belt 2 takes time to increase the viscosity of the ink, however, by combining the ultraviolet ray irradiation and the heating, the ink can be cured to the desired degree within a shorter time period.

After having cured the ink on the transfer belt 2 at the degree that is not completely cured, the driving roller 8 is rotated to move the transfer belt 2 in the direction of the arrow X.

When the transfer belt 2 is moved in the direction of the arrow X, the transfer belt 2 onto which the ink is discharged is moved to between the transparent roller 9 and the transfer roller 10. Then, the transparent roller 9 and the transfer roller 10 sandwich the transfer belt 2 onto which the ink has been discharged and the medium 12, and press them. Thus, the transparent roller 9 and the transfer roller 10 sequentially transfer the ink on the transfer belt 2 onto the medium 12. Since the ink on the medium 12 is cured in the state of being pressed, the image surface upon the transfer is smoothed, and the image quality is improved.

At this occasion, the ultraviolet irradiator 5 delivers the ultraviolet ray on the transparent roller 9. The transparent roller 9 and the transfer belt 2 allow the ultraviolet ray to penetrate, so that the ultraviolet irradiator 5 can deliver the ultraviolet ray through them onto the ink on the medium 12 to cure the ink.

That is, the pressing of the transfer belt 2 and the medium 12 and the delivery of the ultraviolet ray onto the ink on the medium 12 can be performed at once. Thus, the ink on the transfer belt 2 can efficiently be transferred onto the medium 12.

When the ink on the transfer belt 2 is transferred onto the medium 12, the transfer may be performed while moving the transfer belt 2 by the driving roller 8, or the ink transfer onto the medium 12 may be performed after the transfer belt 2 is stopped, and the transfer belt 2 may be moved again after the transfer is finished. When the transfer is performed while moving the transfer belt 2 by the driving roller 8, the moving speed of the transfer belt 2 may suitably be determined based on types of ink, strengths of the ultraviolet ray delivered by the ultraviolet irradiators 4, 5, material of the transfer belt 2 or the medium 12, and the like.

Further, the ink transfer onto the medium 12 can be performed at room temperature, however, to further stabilize the transfer condition, a mechanism for artificially adjusting the temperature by retaining or applying heat so that an environment to perform the transfer is maintained at a certain temperature may be provided in the printing device 100.

The transfer may be performed for each color, or collectively, for example, for every two colors, four colors, or six colors.

When curing the ink on the transfer belt 2 at the degree that is not completely cured, gradient is generated in the viscosity, since the ink starts to dry from its surface. That is, a contact surface of the ink surface contacting the transfer belt 2 has higher viscosity than ink on a side of the surface where the ink has adhered. Thus, the ink is suitably transferred onto the medium 12.

While the ink is being transferred to the medium 12, or after the transfer has finished, the driving roller 8 moves the transfer belt 2 in the direction of the arrow X in the drawing. Due to this, the transfer belt 2 and the medium 12 that were pressed are released from the pressing.

Even after the pressing of the transfer belt 2 and the medium 12 has been released, the transfer belt 2 and the medium 12 are in contact between the transfer roller 10 and the small roller 13, but when the transfer belt 2 and the medium 12 are moved to the small roller 13, the medium 12 is detached from the transfer belt 2. As shown in FIG. 1, by detaching the transfer belt 2 and the medium 12 by making an angle therebetween to be large, the ink remaining on the transfer belt 2 can be suppressed, and the transfer of the ink onto the medium 12 can suitably be performed.

Next, the ultraviolet irradiator 6 delivers the ultraviolet ray onto the ink transferred onto the medium 12. Thus, the ink transferred onto the medium 12 is cured even further.

In case of continuously performing the transfer, the portion of the transfer belt 2 where the ink has been adhering is cleaned by the cleaner 14. Further, the portion of the transfer belt 2 where the ink has been adhering may be cleaned by using a cleaning sheet, and the transfer belt 2 may be washed using washing solution such as alcohol.

In the printing device according to the present invention, the ink jet head performs printing with ink that is cured by exposure to radiation onto the ring-shaped transfer medium. The first curing unit cures the ink at the degree that is not completely cured. Then, the transferring unit transfers the ink that has been cured by the first curing unit onto the recording medium, so that the ink does not soak into the recording medium or smear. Thus, the printing device according to the present invention can provide print image with high quality.

Further, since the printing device according to the present invention uses the ring-shaped transfer medium, it is possible to print sequentially on a web-shaped recording medium or print with long printing length.

Modified Example

In the present embodiment, the transparent roller 9 that allows ultraviolet ray to penetrate is used, however, instead of this, a roller having a gap that allows the ultraviolet ray to pass through may be used. By the roller having the above gap, the ultraviolet ray can be delivered onto the ink on the medium 12 through the gap even when the roller is formed of a material that does not allow the ultraviolet ray to penetrate. As a shape of the gap, for example, a meshed shape may be exemplified.

In the present embodiment, the ultraviolet irradiator 5 is installed in the transparent roller 9, however, a position to provide the ultraviolet irradiator 5 is not limited hereto. For example, the ultraviolet irradiator 5 may be provided so that the ultraviolet ray is delivered directly onto the ink on the medium 12 after the transfer by the transparent roller 9 and the transfer roller 10 has been finished. At this occasion, only the ultraviolet irradiator 5 may be provided without providing the ultraviolet irradiator 6.

In the present embodiment, the ultraviolet irradiator 5 is installed in the transparent roller 9, however, a position to provide the ultraviolet irradiator 5 is not limited hereto. For example, if the transfer roller 10 is a roller allowing ultraviolet ray to penetrate or is a roller having a gap allowing the ultraviolet ray to pass through, and the medium 12 is a member that allows ultraviolet ray to penetrate, the ultraviolet irradiator 5 may be installed in the transfer roller 10. Due to this, the same effect as in the case of installing the ultraviolet irradiator 5 in the transparent roller 9 can be achieved.

Second Embodiment

Figure 2:
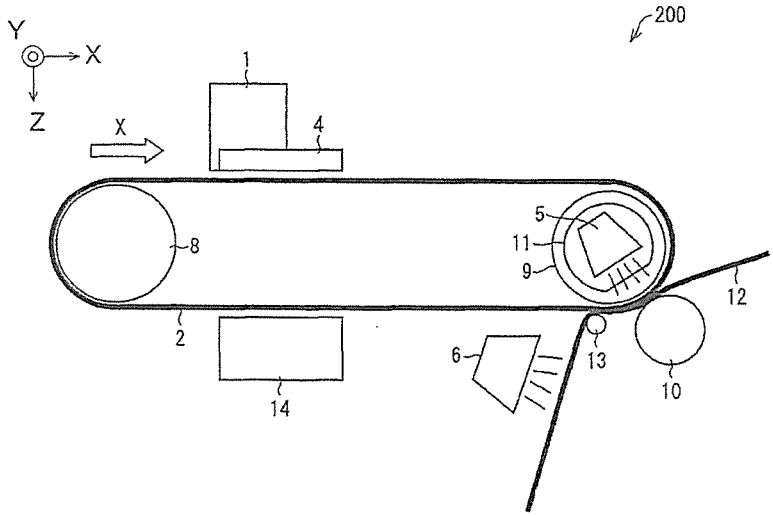
FIG. 2 is a diagram schematically showing a printing device according to a second embodiment of the present invention.

The explanation of the second embodiment of the present invention based on FIG. 2 is as follows. FIG. 2 is a diagram schematically showing a printing device according to the second embodiment of the present invention. It should be noted that, for the sake of convenience of explanation, members having the same functions as those in the drawing described in the first embodiment will be given the same reference signs, and the descriptions thereof will be omitted.

A printing device 200 according to the second embodiment differs from the printing device 100 according to the first embodiment in not having the heater 3.

As ink to be used in the printing device 200, similarly to the first embodiment, it simply needs to include at least one type of curable monomers and curable oligomers that polymerize by delivery of the ultraviolet ray (radiation). Further, the ink may not need to contain any solvent.

The ultraviolet irradiator 4 delivers the ultraviolet ray onto the ink on the transfer belt 2, but the wavelength of the ultraviolet ray at this occasion is preferably 380 nm or more and 420 nm or less, for example. The ink can suitably be cured similarly to the first embodiment by delivering the ultraviolet ray with the wavelength in the above range.

The ultraviolet irradiator 6 may be provided to completely cure the ink transferred onto the medium 12. Due to this, the ink can be completely cured even in cases where the ink could not have been cured completely by the irradiation of the ultraviolet ray by the ultraviolet irradiators 4, 5. The ultraviolet irradiator 6 delivers ultraviolet ray onto the ink on the medium 12, however, the wavelength of the ultraviolet ray at this occasion is preferably 350 nm or more and 420 nm or less, for example.

Further, the ultraviolet irradiator 5 does not need to be installed in the transparent roller 9, and the ultraviolet irradiator 6 may be used as the second curing unit without providing the ultraviolet irradiator 5. It should be noted that, in case of providing the ultraviolet irradiator 5, the ultraviolet irradiator 5 delivers the ultraviolet ray onto the ink on the transfer belt 2, however, the wavelength of the ultraviolet ray at this occasion is preferably for example 350 nm or more and 420 nm or less. Further, the ink becomes more easily exfoliated from the transfer belt 2 by the ultraviolet irradiator 5 irradiating the ink with the ultraviolet ray with the shorter wavelength than the ultraviolet ray delivered from the ultraviolet irradiator 4.

As above, the printing device 200 according to the present embodiment can provide a printed image with the high image quality, and further, it can sequentially perform printing on the web-shaped medium 12, or print with long printing length.

Third Embodiment

Figure 3A:
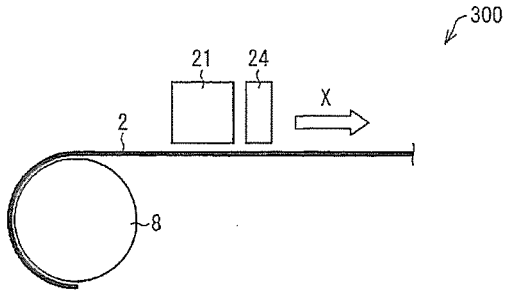
FIG. 3A and FIG. 3B are diagrams schematically showing a printing device according to a third embodiment of the present invention, where
Figure 3B:
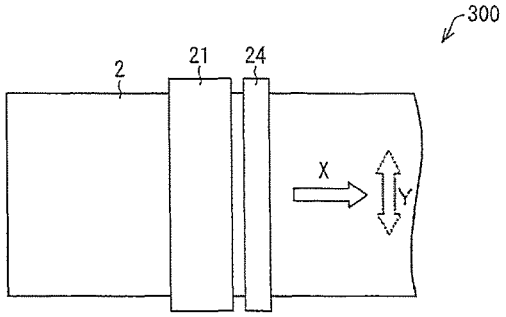

The explanation of the third embodiment of the present invention based on FIG. 3A and FIG. 3B is as follows. FIG. 3A and FIG. 3B are diagrams schematically showing a printing device according to the third embodiment of the present invention, where FIG. 3A is a front view of the printing device, and FIG. 3B is a top view thereof. It should be noted that, for the sake of convenience of explanation, members having the same functions as those in the drawing described in the first embodiment will be given the same reference signs, and the descriptions thereof will be omitted.

A printing device 300 according to the third embodiment differs from the printing device 100 according to the first embodiment in that it includes a line head 21 and an ultraviolet irradiator 24 (first curing unit) instead of the ink jet head 1 that discharges ink onto the transfer belt 2 while moving, and the ultraviolet irradiator 4 that delivers the ultraviolet ray onto the ink while moving.

The line head 21 and the ultraviolet irradiator 24 are parallel to the transfer belt 2 in a vertical direction with respect to the moving direction of the transfer belt 2 (the direction of the arrow X in FIG. 3A and FIG. 3B), and in a surface direction of the transfer belt 2. Thus, in the printing device 300, only the transfer belt 2 needs to be moved in the direction of the arrow X when the ink is discharged from the line head 21 onto the transfer belt 2 and when the ultraviolet ray is delivered onto the ink adhered to the transfer belt 2 from the ultraviolet irradiator 24.

Similar to the printing device 100 according to the first embodiment and the printing device 200 according to the second embodiment, the printing device 300 according to the present embodiment can provide a printed image with the high image quality, and further, it can sequentially perform printing on the web-shaped medium 12, or print with long printing length.

[Supplementary Information]

As above, the printing device 100 according to one embodiment of the present invention includes the ink jet head 1 that discharges the ink that is cured by having the ultraviolet ray delivered; the ring-shaped transfer belt 2 being the transfer belt 2 onto which the ink is discharged, being configured to transfer the ink onto the medium 12 by causing the ink discharged on the transfer belt 2 to make contact with the medium 12; the ultraviolet irradiator 4 that cures the ink discharged on the transfer belt 2 at the degree that is not completely cured; the driving roller 8 that rotationally drives the transfer belt 2; and the ultraviolet irradiator 5 that presses the transfer belt 2, on which the ink cured by the ultraviolet irradiator 4 has been discharged, and the medium 12 to transfer the ink onto the medium 12.

Firstly, the ink jet head 1 performs printing with the ink that is cured by having the ultraviolet ray delivered thereon on the ring-shaped transfer belt 2. The ultraviolet irradiator 4 cures the ink at the degree that is not completely cured. Then, the transferring unit transfers the ink that has been cured by the ultraviolet irradiator 4 onto the medium 12, so that the ink does not soak into the medium 12 or smear. Thus, the printing device 100 can provide a printed image with high quality.

The printing device 100 according to one embodiment of the present invention uses the ring-shaped transfer belt 2, so that printing can be performed sequentially on the web-shaped medium 12, or printing with long printing length can be performed.

In the printing device 100, the transferring unit includes the transparent roller 9 provided inside the ring of the ring-shaped transfer belt 2, and the transfer roller 10 provided at the position facing the transparent roller 9 with the transfer belt 2 and the medium 12 sandwiched therebetween, and the transparent roller 9 and the transfer roller 10 are configured to press the transfer belt 2 and the medium 12.

According to the above configuration, the transparent roller 9 and the transfer roller 10 sandwich the transfer belt 2 and the medium 12, and press them. Due to this, the ink on the transfer belt 2 can sequentially be transferred onto the medium 12.

In the printing device 100, the ultraviolet irradiator 5 is installed in the transparent roller 9, and the transparent roller 9 is a roller allowing the ultraviolet ray to penetrate or a roller having the gap allowing the ultraviolet ray to pass through, and the transfer belt 2 is formed of a member that allows the ultraviolet ray to penetrate.

The transparent roller 9 is a roller that allows the radiation to penetrate or pass through, and the transfer belt 2 is formed of the member that allows the radiation to penetrate. Due to this, the pressing of the transfer belt 2 and the medium 12 and the irradiation of the ultraviolet ray onto the ink on the medium 12 can be performed at once. Thus, the ink on the transfer belt 2 can efficiently be transferred onto the medium 12.

Further, since the ink on the medium 12 is cured in a state where the transfer belt 2 and the medium 12 are pressed, the image surface upon the transfer is smoothed, and the image quality is improved.

Moreover, since the ultraviolet irradiator 5 is installed in the transparent roller 9, the printing device 100 can be made compact.

In the printing device 100, the ink jet head 1 moves in the vertical direction with respect to the moving direction of the transfer belt 2 and in the direction parallel to the surface direction of the transfer belt 2, and the ultraviolet irradiator 4 delivers the ultraviolet ray onto the ink on the transfer belt 2 and cures the ink at the degree that is not completely cured, and moves in the state in which the relative position with respect to the ink jet head 1 is maintained.

The ultraviolet irradiator 4 delivers the ultraviolet ray onto the ink on the transfer belt 2 while moving in a state of maintaining a relative position with respect to the ink jet head 1. That is, since the ink is cured while discharging the ink from the ink jet head 1 onto the transfer belt 2, for example, the ink that has just struck the transfer belt 2 can be cured. Accordingly, the smearing of the ink on the transfer belt 2 can be prevented.

In the printing device 100, the ultraviolet irradiator 4 includes the heater 3 for heating the surface of the transfer belt 2 where the ink is to be discharged.

The ink discharged on the transfer belt 2 can be heated by the heater 3. Due to this, for example, in the case where solvent is included in the ink, the solvent can be volatilized to increase viscosity of the ink, so that ink smearing and excessive leveling can be suppressed.

In the printing device 100, the heater 3 heats the surface of the transfer belt 2 where the ink is to be discharged to 40° C. or more and 80° C. or less.

By heating the ink on the transfer belt 2 within the above temperature range, the solvent contained in the ink can efficiently be volatilized to suitably increase the viscosity of the ink.

The present invention is not limited to the above-described respective embodiments, but various modifications can be made within the scope shown in the claims; and embodiments obtained by suitably combining the technical features disclosed separately in different embodiments are also included in the technical scope of the present invention.

INDUSTRIAL APPLICABILITY

The present invention can be used in printing fields such as multi-pass printing and the like.

The invention claimed is:

1. A printing device, comprising:

an ink jet head that discharges ink that is cured by having radiation delivered;

a ring-shaped transfer medium being a transfer medium onto which the ink is discharged and allows the radiation to penetrate, being configured to transfer the ink onto a recording medium by causing the ink discharged on the transfer medium to make contact with the recording medium;

a first curing unit, performing a first curing process that cures the ink discharged on the transfer medium at a degree that is not completely cured;

a driving unit that rotationally drives the transfer medium;

a transferring unit that presses the transfer medium, on which the ink cured by the first curing process has been discharged, and the recording medium to transfer the ink onto the recording medium;

a second curing unit, performing a second curing process that delivers radiation on the ink on the recording medium after the first curing process to cure the ink; and a detaching roller, disposed downstream of the transferring unit, that allows the recording medium to be detached from the transfer medium;

the ink jet head discharge the ink while moves in a direction that is parallel to a surface direction of the transfer medium;

the transferring unit includes a first roller provided inside a ring of the ring-shaped transfer medium, and a second roller provided at a position facing the first roller with the transfer medium and the recording medium sandwiched therebetween, and the first roller and the second roller press the transfer medium and the recording medium;

the second curing unit is installed in the first roller that allows radiation to penetrate or to pass through;

the second curing unit and the transferring unit perform the second curing process and a transferring process at the same time, wherein in the transferring process, a pressing position of the transfer medium based on the transfer unit and the recording medium is irradiated by the radiation irradiated from the second curing unit;

at least one portion of an area between the transfer unit and the detached roller is irradiated by the radiation irradiated by the second curing unit.

2. The printing device according to claim 1, wherein the first roller is a roller having a gap for allowing the radiation to pass through.

3. The printing device according to claim 1, wherein the first curing unit delivers the radiation onto the ink on the transfer medium and cures the ink at the degree that is not completely cured, and moves in a state in which a relative position with respect to the ink jet head is maintained.

4. The printing device according to claim 1, wherein the first curing unit includes a heating unit that heats a surface of the transfer medium onto which the ink is discharged.

5. The printing device according to claim 4, wherein the heating unit heats the surface of the transfer medium onto which the ink is discharged to 40° C. or more and 80° C. or less.

* * * * *